US006892040B2

(12) United States Patent
Ahn et al.

(10) Patent No.: US 6,892,040 B2
(45) Date of Patent: May 10, 2005

(54) COOLING APPARATUS OF AN IMAGE FORMING APPARATUS

(75) Inventors: Byung-sun Ahn, Gyeonggi-do (KR); Dong-woo Kim, Seoul (KR); Jung-gee Baek, Busan (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/256,170

(22) Filed: Sep. 27, 2002

(65) Prior Publication Data

US 2003/0147665 A1 Aug. 7, 2003

(30) Foreign Application Priority Data

Feb. 7, 2002 (KR) ..... 2002-7024

(51) Int. Cl.[7] ..... G03G 21/20
(52) U.S. Cl. ..... 399/92
(58) Field of Search ..... 399/92–94; 165/89

(56) References Cited

U.S. PATENT DOCUMENTS 5,189,473 A * 2/1993 Negoro et al. ..... 399/93
6,173,132 B1 * 1/2001 Kida et al. ..... 399/92
6,219,504 B1 * 4/2001 Matsuzaki et al. ..... 399/92

FOREIGN PATENT DOCUMENTS

JP 8-063084 3/1996
JP 10268735 A * 10/1998 ..... G03G/21/20
JP 2000029283 A * 1/2000 ..... G03G/15/02
JP 2000235338 A * 8/2000 ..... G03G/21/20
JP 2000293089 A * 10/2000 ..... G03G/21/20
JP 2001013856 A * 1/2001 ..... G03G/21/20

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A cooling apparatus of an electrophotographic image forming apparatus includes a cooling fan and a first opening. The cooling fan emits heat in the electrophotographic image forming apparatus to an outside of the electrophotographic image forming apparatus, is installed in any one of two frames that are opposite to each other so as to support a fusing unit, is disposed in a direction where a paper is discharged from the fusing unit, and allows internal air to flow out. The first opening is formed in a first frame that is opposite to a second frame in which the cooling fan is installed, and allows external air to flow into the electrophotographic image forming apparatus. The cooling apparatus is applied to a dry or wet electrophotographic image forming apparatus. The cooling apparatus emits heat generated from a fusing unit to the outside without affecting temperatures of a photosensitive drum and a developer unit so as to prolong a usable period of the photosensitive drum and improve an image quality. Also, waste toner is not congealed so as to reduce a load exerted on the cooling apparatus and the developer unit.

24 Claims, 5 Drawing Sheets

COOLING APPARATUS OF AN IMAGE FORMING APPARATUS

CROSS-REFERENCE TO RELATED APPLICATIONS

This application claims the benefit of Korean Patent Application No. 2002-7024, filed Feb. 7, 2002, in the Korean Intellectual Property office, the disclosure of which is incorporated herein by reference.

BACKGROUND OF THE INVENTION

1. Field of the Invention

The present invention relates to an electrophotographic image forming apparatus, and more particularly, to a cooling apparatus for lowering a temperature of a body that is increased by heat generated from a fusing apparatus.

2. Description of the Related Art

A electrophotographic apparatus generally forms a latent electrostatic image on a photosensitive medium, such as a photosensitive belt or a photosensitive drum, develops the latent electrostatic image with toner, and transfers the developed latent electrostatic image to a sheet of paper to form an image.

The electrophotographic apparatus is classified into one of wet and dry electrophotographic printers according to a kind of toner. The dry electrophotographic printer uses powdered toner while the wet electrophotographic printer uses a liquid developer containing volatile liquid carrier toner. The wet electrophotographic printer can perform quality printing, compared to the dry electrophotographic printer, and prevent damage occurring due to harmful toner dust.

FIG. 1 is a cross-sectional view of a conventional dry electrophotographic image forming apparatus 100. FIG. 2 is a perspective view explaining an airflow generated by a cooling apparatus 170 shown in FIG. 1.

Referring to FIG. 1, the dry electrophotographic image forming apparatus 100 includes a developer unit 120, a transfer unit 130, a fusing unit 140, a paper supplying unit 160, and the cooling apparatus 170.

The developer unit 120 coats a latent electrostatic image formed on a photosensitive drum 121 by a laser scanning unit 110 with a developer supplied from a developer tank 122 to form a toner image.

The transfer unit 130 is installed so as to be disposed opposite to the photosensitive drum 121 to rotate together with the photosensitive drum 121. A sheet of paper P is inserted between the photosensitive drum 121 and the transfer unit 130 and simultaneously, the toner image formed on the photosensitive drum 121 is transferred to the paper.

The fusing unit 140 is installed in a paper discharging pathway and fuses the toner image which has been transferred to the paper by the transfer unit 130 to the paper by predetermined heat and pressure.

The paper supplying unit 160 supplies the paper P, to which the toner image will be transferred, to a transfer nip between the photosensitive drum 121, on which the toner image has been formed, and the transfer unit 130. The paper supplying unit 160 includes a pickup roller 161 and transfer rollers 162 and 163. The pickup roller 161 picks up the paper P stacked on a tray 152 supported by a spring 153 in a cassette 151 that is installed to be detached from and attached to a printer body, and supplies the picked-up paper P into a printer body. The transfer rollers 162 and 163 transfer the paper P which has been picked up by the pickup roller 161 inside the printer body.

The cooling apparatus 170 maintains a temperature in the dry electrophotographic image forming apparatus 100 to a predetermined temperature by lowering the temperature increased by heat that is generated in the fusing unit 140 and is spread around. The cooling apparatus 170 is installed on a front frame 181 (See FIG. 2) to be disposed between the fusing unit 140 and the developer unit 120 and includes a first opening 172 and a cooling fan 171. The first opening 172 is formed in a back frame 182 (See FIG. 2). The cooling fan 171 allows external air having a low temperature to flow into the printer body through a second opening 173 which is formed in a side frame 183 that is installed to be perpendicular to the front and back frames 181 and 182.

When the cooling fan 171 operates, a pressure difference occurs in the printer body of the dry electrophotographic image forming apparatus 100. Due to the pressure difference, when the external air having the low temperature flows into the printer body through the first and second openings 172 and 173, internal air whose temperature is increased by heat generated from the fusing unit 140 is discharged outside. As a result, the temperature in the printer body drops so as to be maintained at the predetermined temperature.

Referring to FIG. 2, the external air induced through the first and second openings 172 and 173 by an operation of the cooling fan 171 flows in A, B, and D directions and then flows out through the cooling fan 171.

When the cooling fan 171 operates, air may flow in C and E directions because of airflow characteristics. Heat generated in the fusing unit 140 is transmitted through C and D directions to the developer unit 120. Thus, temperatures of the developer unit 120 and the photosensitive drum 121 are increased.

An increase in the temperature of the photosensitive drum 121 causes a reduction of a usable period of the photosensitive drum 121. In particular, if a temperature of toner is 55° C. or more, characteristics of toner are changed. Thus, a density of an image quality deteriorates.

Also, due to an increase in a temperature of a waste toner storage (not shown), toner is fused to the waste toner storage, or characteristics thereof are changed, resulting in congelation of the toner. As a result, a load exerted on the cooling apparatus may sharply increase and internal parts of the printer body may be damaged.

SUMMARY OF THE INVENTION

To solve the above and other problems, it is an object of the present invention to provide a cooling apparatus of an electrophotographic image forming apparatus which is improved so as to keep an image clear by lowering a temperature in the electrophotographic image forming apparatus without increasing a temperature of a developer unit.

Additional objects and advantageous of the invention will be set forth in part in the description which follows and, in part, will be obvious from the description, or may be learned by practice of the invention.

Accordingly, to achieve the above and other objects, there is provided a cooling apparatus of an electrophotographic image forming apparatus including a cooling fan and a first opening. The cooling fan emits heat in the electrophotographic image forming apparatus to an outside of the electrophotographic image forming apparatus, is installed in any one of two frames that are disposed opposite to each other so as to support a fusing unit, is disposed in a direction where a sheet of paper is discharged from the fusing unit, and allows internal air to flow out. The first opening is formed in a frame that is disposed opposite to a frame in which the cooling fan is installed, and allows external air to flow into the electrophotographic image forming apparatus.

BRIEF DESCRIPTION OF THE DRAWINGS

The above and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENTS

Figure 1:
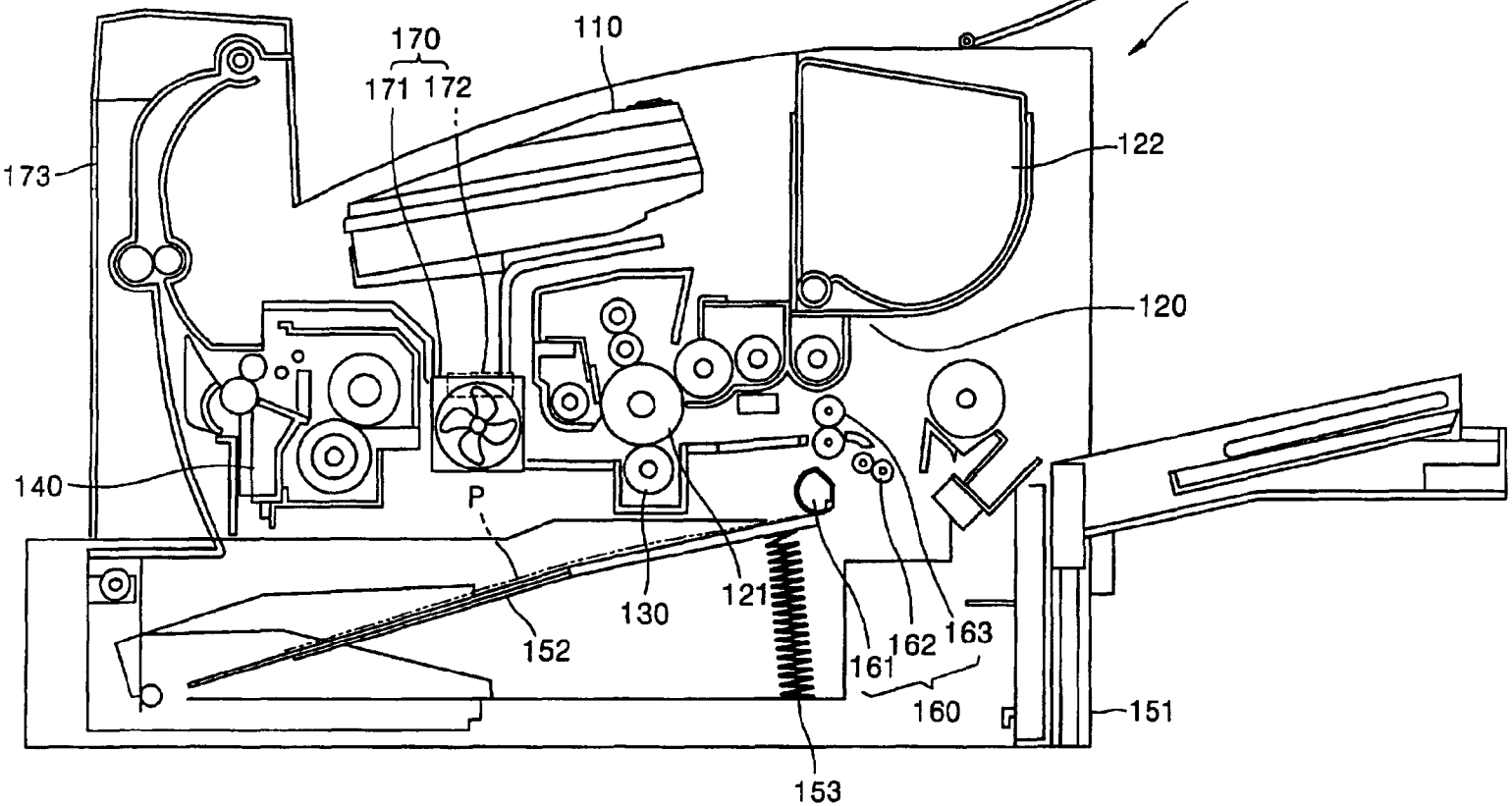
FIG. 1 (PRIOR ART)
FIG. 1 is a cross-sectional view of a conventional dry electrophotographic image forming apparatus.
Figure 2:
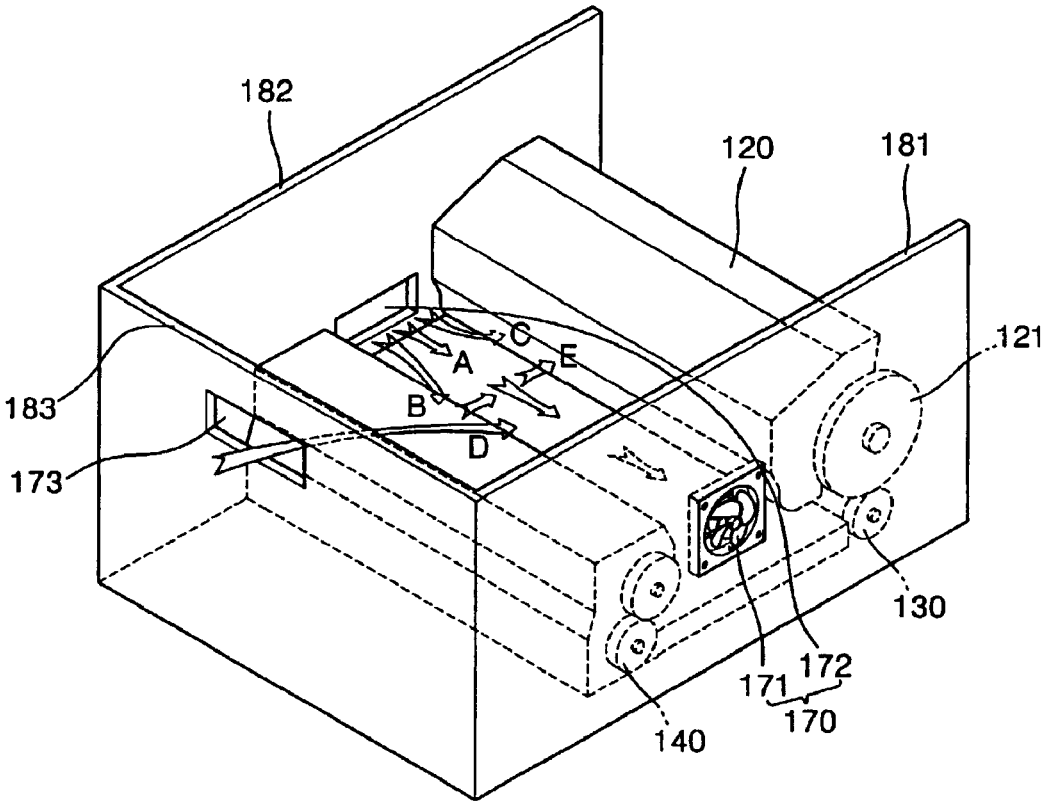
FIG. 2 (PRIOR ART)
FIG. 2 is a perspective view explaining an airflow formed by a cooling apparatus shown in FIG. 1.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Figure 3:
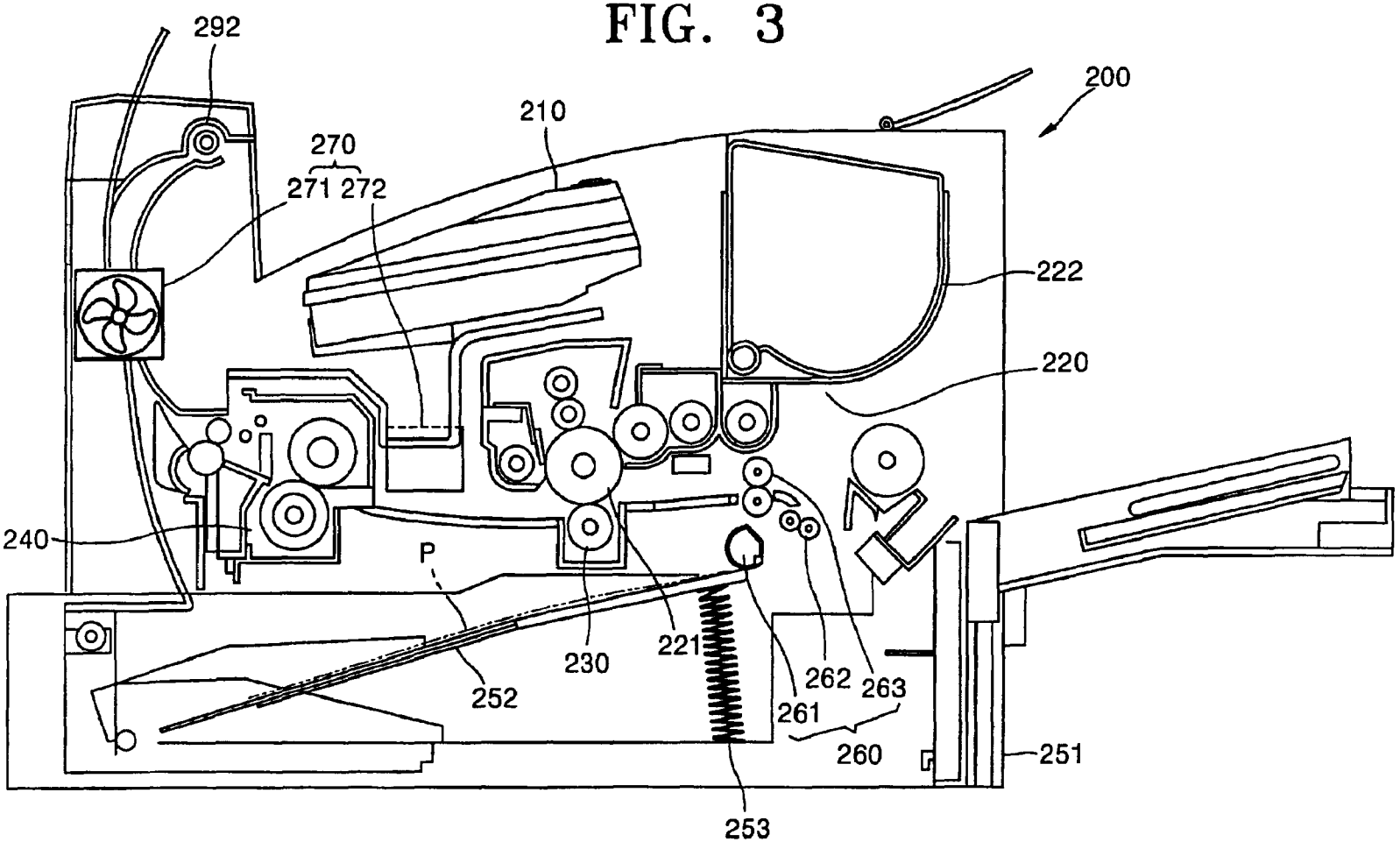
FIG. 3 is a cross-sectional view of a dry electrophotographic image forming apparatus having a cooling apparatus according to an embodiment of the present invention.

FIG. 3 is a cross-sectional view of a dry electrophotographic image forming apparatus 200 having a cooling apparatus 270 according to an embodiment of the present invention. It is understood that the cooling apparatus 270 according to the present invention is not limited to the dry electrophotographic image forming apparatus but can be applied to a wet electrophotographic image forming apparatus.

Referring to FIG. 3, the dry electrophotographic image forming apparatus 200 (hereinafter, referred to as an "image forming apparatus") includes a developer unit 220, a transfer unit 230, a fusing unit 240, a paper supplying unit 260, and the cooling apparatus 270.

The developer unit 220 coats (develops) a latent electrostatic image formed on a photosensitive drum 221 by a laser scanning unit 210 with a developer supplied from a developer tank 222 to form a predetermined toner image.

The transfer unit 230 is installed so as to be disposed opposite to the photosensitive drum 221 to rotate together with the photosensitive drum 221. A sheet of paper P is inserted between the photosensitive drum 221 and the transfer unit 230 and simultaneously, the toner image formed on the photosensitive drum 221 is transferred to the paper P.

The fusing unit 240 fuses the toner image which has been transferred to the paper P by the transfer unit 230 to the paper P by predetermined heat and pressure. The paper P is discharged from the fusing unit 240 to an outside of the electrophotographic image forming apparatus 200 through a paper discharging unit 292.

The paper supplying unit 260 supplies the paper P to a transfer nip between the photosensitive drum 221 and the transfer unit 230. The paper supplying unit 260 includes a is pickup roller 261 and transfer rollers 262 and 263. The pickup roller 161 picks up the paper P loaded on a tray 252 supported by a spring 253 in a cassette 251 that is installed to be detached from and attached to a printer body, and supplies the paper P into the printer body. The transfer rollers 262 and 263 transfer the paper P which has been picked up by the pickup roller 61 into the printer body.

The cooling apparatus 270 lowers a temperature in the image forming apparatus 200 which is increased by heat generated in the fusing unit 240, and includes a cooling fan 271 and a first opening 272.

Figure 4:
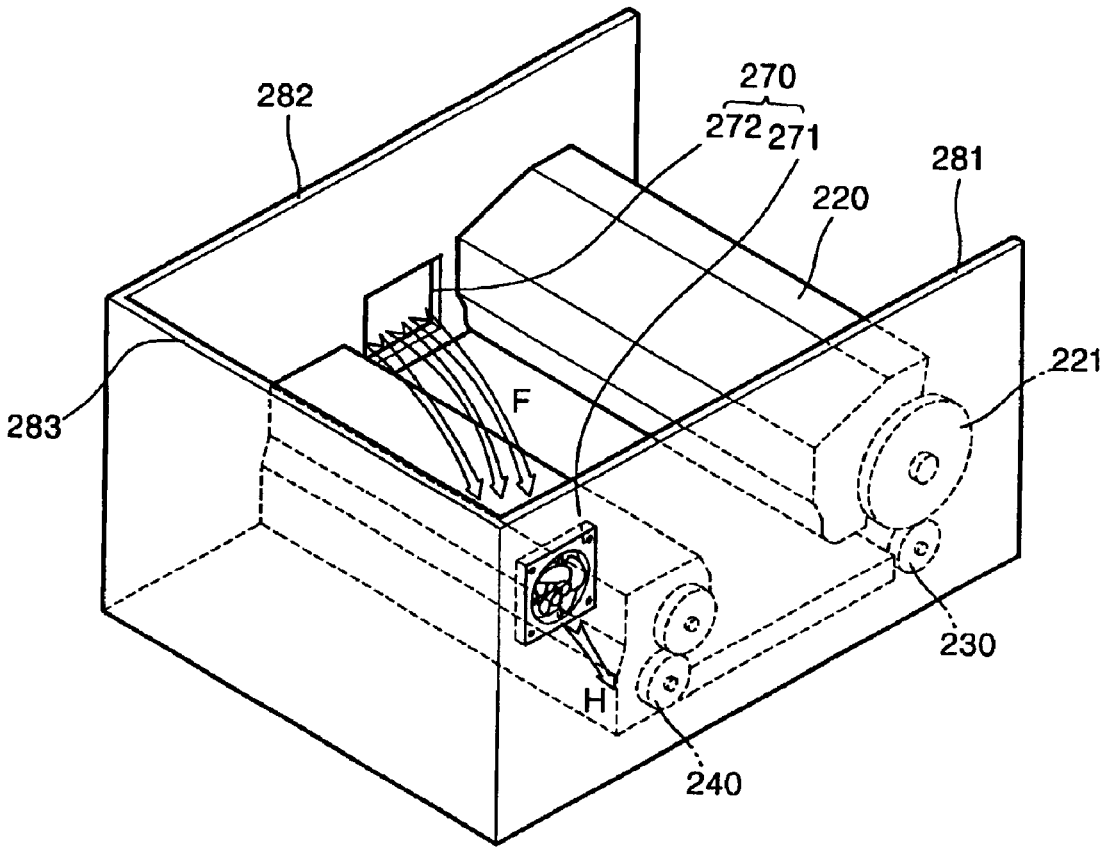
FIG. 4 is a perspective view explaining an airflow formed by the cooling apparatus shown in FIG. 3.

FIG. 4 is a perspective view explaining an airflow formed by the cooling apparatus shown in FIG. 3. Referring to FIGS. 3 and 4, the cooling fan 271 is installed in a front frame 281 in which one end of the fusing unit 240 is installed. The cooling fan 271 is positioned in a direction where the paper P is discharged from the fusing unit 240 and is adjacent to a side frame 283 which is perpendicular to the front frame 281. The paper discharging unit 292 may be disposed on the side frame 283 or between the side frame 283 and the fusing unit 240. The cooling fan 271 may be disposed between the fusing unit 240 and the paper discharging unit 292 or the side frame 283.

The cooling fan 271 is higher than the fusing unit 240 from the bottom of the image forming apparatus 200. The first opening 272 is formed in a back frame 282 that is disposed opposite to the front frame 281, but it is possible to form the first opening 272 between the developer unit 220 and the fusing unit 240.

The cooling fan 271 is installed in the direction where the paper is discharged from the fusing unit 240, and the first opening 272 is formed in a first frame that is disposed opposite to a second frame in which the cooling fan 271 is installed.

In particular, it is possible that the first opening 272 is formed between the developer unit 220 and the fusing unit 240. External air, which flows through the first opening 272, passes through the fusing unit 240 and the cooling fan 271 to the outside of the image forming apparatus 200 so that a temperature in the developer unit 220 is not affected by heat generated from the fusing unit 24 when a temperature in the image forming apparatus 200 is lowered by the external air.

In this embodiment of the present invention, the cooling fan 271 is formed in the front frame 281, and the first opening 272 is formed in the back frame 282. However, the cooling fan 217 may be formed in the back frame 282, and the first opening 272 may be formed in the front frame 281.

Since air in the image forming apparatus 200 flows out with an operation of the cooling fan 271, an internal pressure in the image forming apparatus 200 becomes lower. Thus, external air, which has an external pressure higher than the internal pressure, flows through the first opening 272 into the image forming apparatus 200.

The external air, which has flowed into through the first opening 272, flows in an F direction, passes through the fusing unit 240 and the cooling fan 272, and flows in an H direction to the outside of the image forming apparatus 200.

Here, the external air flows out with heat generated from the fusing unit 240 and heat in the image forming apparatus 200. As a result, the temperature in the image forming apparatus 200 drops.

Figure 5:
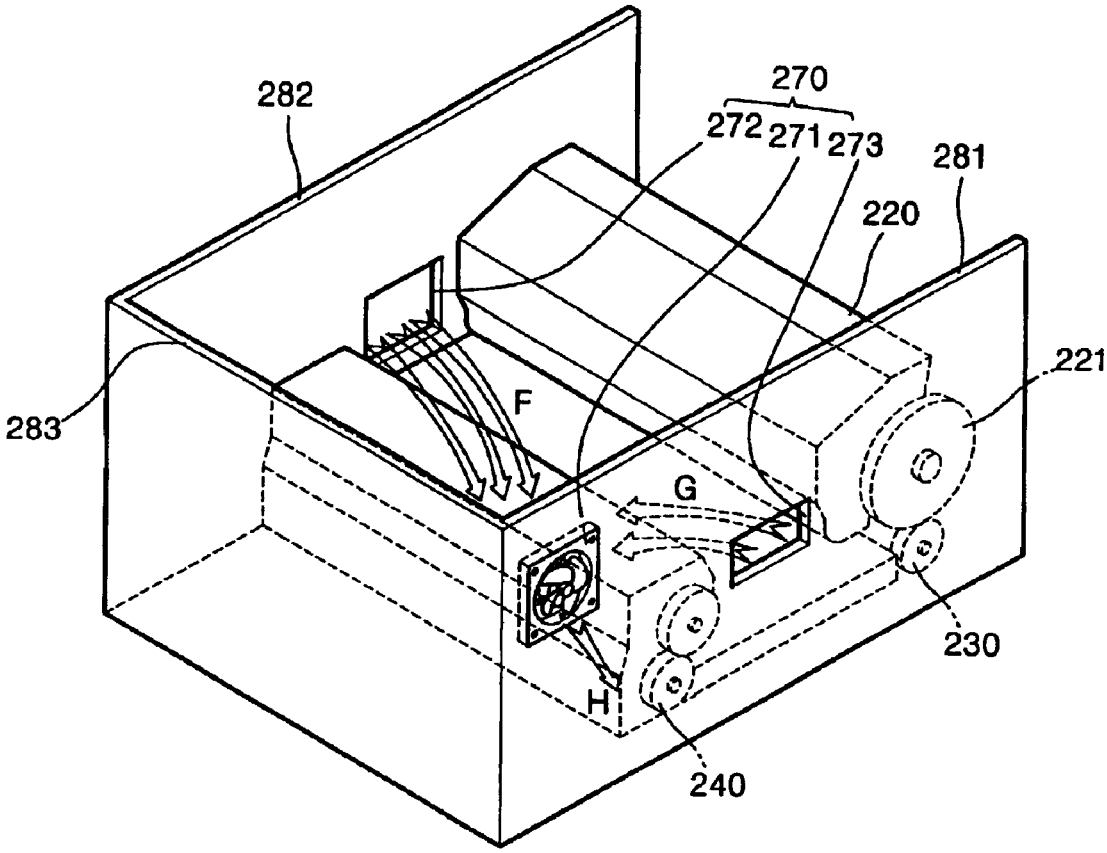
FIG. 5 is a perspective view explaining airflow formed by a cooling apparatus according to another embodiment of the present invention.

FIG. 5 is a perspective view explaining airflow formed by a cooling apparatus according to another embodiment of the present invention. Referring to FIG. 5, a basic structure is the same as the structure shown in FIG. 4. However, a second opening 273 is formed in the front frame 281, in which the cooling fan 271 is installed, to be disposed opposite to the first opening 272 formed on the back frame 282.

The external air flows through the first opening 272 in the F direction (see FIG. 4) and toward the cooling fan 271. Here, since the external air flows through the first opening 272 to the cooling fan 271 that is diagonal to the first opening 272, the external air may not smoothly flow to the fusing unit 240 that is positioned toward the front frame 281. Thus, it may be difficult to effectively discharge the heat generated by the fusing unit 240.

Therefore, as show in FIG. 5, the second opening 273 is formed in the front frame 281, in which the cooling fan 271 is installed, and between the developer unit 220 and the fusing unit 240.

The external air, which has flowed through the second opening 273, flows in a G direction, and flows out through the cooling fan 271 in the H direction. Thus, the external air can flow throughout the fusing unit 240.

Here, it is possible that an area of the first opening 272 is wider than that of the second opening 273. The external air flowing through the first opening 272 in the F direction can effectively lower the temperature in the image forming apparatus 200.

The first and second openings 272 and 273 are not limited to a rectangular shape as shown in the embodiment of the present invention and may have various shapes which can allow the external air to flow into the image forming apparatus 200.

As described above, the cooling apparatus of the image forming apparatus according to the present invention emits heat generated from the fusing unit to the outside without affecting the temperature of the photosensitive drum and the developer unit so as to prolong a usable period of the photosensitive drum and improve image quality. Also, waste toner is not congealed so as to reduce a load exerted on the cooling apparatus and the developer unit.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A cooling apparatus of an image forming apparatus having a body having a bottom, a fusing unit, and opposite frames disposed on opposite sides of the bottom to support the fusing unit, comprising:

a paper discharging unit disposed higher than the fusing unit with respect to the bottom to communicate with the fusing unit through a paper feeding path;

a cooling fan which emits heat in the image forming apparatus to an outside of the image forming apparatus, is installed in one of the opposite frames, is disposed on the paper feeding path between the fusing unit and the paper discharging unit in a first direction, in which a sheet of paper is discharged from the fusing unit, and induces air from the image forming apparatus to flow to the outside; and a first opening that is positioned on the paper feeding path in the other frame other than the one of the opposite frames in which the cooling fan is installed, the cooling fan drawing external air through the first opening, into the image forming apparatus, and across the fusing unit in the first direction.

2. The cooling apparatus of claim 1, wherein the image forming apparatus comprises a developer unit, and the first opening is disposed between the developer unit and the fusing unit.

3. The cooling apparatus of claim 1, wherein a second opening is positioned in the one of the opposite frames in which the cooling fan is installed; and the cooling fan draws external air from the second opening, across the fusing unit, in the first direction.

4. The cooling apparatus of claim 3, wherein the second opening is disposed between the developer unit and the fusing unit.

5. The cooling apparatus of claim 3, wherein an area of the first opening is greater than that of the second opening.

6. The cooling apparatus of claim 1, wherein the cooling fan is disposed above the fusing unit and below the paper discharging unit with respect to the bottom of the body of the image forming apparatus.

7. A cooling apparatus of an image forming apparatus having a frame containing a bottom, a developer unit, and a fusing unit, the cooling apparatus comprising:

a paper discharging unit disposed higher than the fusing unit with respect to the bottom to discharge a sheet of paper toward an outside of the image forming apparatus through a paper feeding path, the paper feeding path being defined from the developer unit to the fusing unit to the paper discharging unit;

a cooling fan mounted on the frame and disposed between the fusing unit and the paper discharging unit to discharge internal air contained in the image forming apparatus to the outside of the image forming apparatus; and an opening positioned on the frame and disposed on the paper feeding path between the developer unit and the fusing unit, the cooling fan drawing external air from the opening, across the fusing unit, in a direction of the paper feeding path, when the cooling fan operates.

8. The cooling apparatus of claim 7, wherein the cooling fan has a height higher than that of the fusing unit and lower than that of the paper discharging unit from the bottom of the frame.

9. The cooling apparatus of claim 8, wherein the fusing unit comprises a fusing roller having a longitudinal axis, and the cooling fan has a center higher than the longitudinal axis of the fusing roller of the fusing unit from the bottom of the frame.

10. The cooling apparatus of claim 7, wherein the frame comprises first and second side frames disposed on opposite ends of the fusing unit, and the cooling fan is disposed on the first side frame, and is adjacent to one of the opposite ends of the fusing unit.

11. The cooling apparatus of claim 7, wherein the cooling fan and the opening forms an air flow from the opening to the cooling fan through the fusing unit when the cooling fan operates.

12. The cooling apparatus of claim 11, wherein the air flow does not move toward the developer unit.

13. The cooling apparatus of claim 11, wherein the fusing unit comprises a body having first and second ends disposed adjacent to both ends of the fusing unit, and the air flow moves from the first end of the fusing unit to the second end of the fusing unit by passing the fusing unit.

14. The cooling apparatus of claim 13, wherein the first and second ends are disposed opposite sides of the fusing unit with respect to a longitudinal axis of the fusing unit perpendicular to a direction from the developer unit to the fusing unit, and the cooling fan is disposed adjacent to the second end of the fusing unit while the opening is disposed adjacent to the first end of the fusing unit.

15. The cooling apparatus of claim 11, wherein the internal air disposed around the fusing unit moves toward the cooling fan.

16. The cooling apparatus of claim 11, wherein the external air flowing into the inside does not flow toward the developer unit when the cooling fan operates.

17. A cooling apparatus of an image forming apparatus having a frame containing a bottom, a developer unit, and a fusing unit, comprising:

a paper discharging unit disposed higher than the fusing unit with respect to the bottom to discharge a sheet of paper toward an outside of the image forming apparatus through a paper feeding path;

a cooling fan mounted on the frame and disposed between the fusing unit and the paper discharging unit to discharge internal air contained in the image forming apparatus to the outside of the image forming apparatus; and an opening formed on the frame and disposed between the developer unit and the fusing unit to allow external air to flow into an inside of the image forming apparatus toward the fusing unit when the cooling fan operates, wherein the frame comprises first and second side frames disposed on opposite ends of the fusing unit, the cooling fan is disposed on the first side frame and adjacent to one of the opposite ends of the fusing unit, and the opening is disposed on the second side frame and adjacent to another one of the opposite ends of the fusing unit.

18. A cooling apparatus of an image forming apparatus having a frame comprising a bottom, a developer unit, and a fusing unit, the cooling apparatus comprising:

a paper discharging unit disposed higher than the fusing unit with respect to the bottom to discharge a sheet of paper toward an outside of the image forming apparatus through a paper feeding path;

a cooling fan mounted on the frame and disposed between the fusing unit and the paper discharging unit to discharge internal air contained in the image forming apparatus to the outside of the image forming apparatus; and an opening formed on the frame and disposed between the developer unit and the fusing unit to allow external air to flow into an inside of the image forming apparatus toward the fusing unit when the cooling fan operates wherein the cooling fan and the opening forms an air flow from the opening to the cooling fan through the fusing unit when the cooling fan operates, the fusing unit comprises a body having first and second ends, and the first and second ends are disposed toward the developer unit and the paper discharging unit, respectively, and the air flow passes over the body of the fusing unit from the first end to the second end.

19. A cooling apparatus of an image forming apparatus having a frame containing a bottom, a developer unit, and a fusing unit, comprising:

a paper discharging unit disposed higher than the fusing unit with respect to the bottom to discharge a sheet of paper toward an outside of the image forming apparatus through a paper feeding path;

a cooling fan mounted on the frame and disposed between the fusing unit and the paper discharging unit to discharge internal air contained in the image forming apparatus to the outside of the image forming apparatus; and an opening formed on the frame and disposed between the developer unit and the fusing unit to allow external air to flow into an inside of the image forming apparatus toward the fusing unit when the cooling fan operates wherein the cooling fan and the opening forms an air flow from the opening to the cooling fan through the fusing unit when the cooling fan operates, and the internal air disposed around the developer unit moves toward the cooling fan through the fusing unit.

20. A cooling apparatus of an image forming apparatus having first and second opposing side walls, and a paper feeding path passing a developer unit, a fusing unit, and a paper discharging unit in order, the cooling apparatus comprising:

a cooling fan disposed on the first side wall, on the paper feeding path between the fusing unit and the paper discharging unit, higher than one of the developer unit and the fusing unit with respect to the paper feeding path between the developer unit and the fusing unit; and an opening disposed on the second side wall, on the paper feeding path, between the fusing unit and the developer unit, the cooling fan drawing external air from the opening, across the fusing unit, in a direction of the paper feeding path.

21. The cooling apparatus of claim 20, wherein the image forming apparatus comprises first and second side frames disposed both sided of the paper feeding path, and the cooling fan is formed on the first side frame while the opening is formed on the second side frame.

22. A cooling apparatus of an image forming apparatus having a paper feeding path passing a developer unit, a fusing unit, and a paper discharging unit in order, the cooling apparatus comprising:

a first side wall of the image forming apparatus, having a first opening positioned on the paper feeding path between the developer unit and the fusing unit;

a second side wall of the image forming apparatus opposing the first side wall; and a cooling fan, positioned on the second side wall, on the paper feeding path, between the fusing unit and the paper discharging unit, and drawing external air from the first opening across the fusing unit in a direction of the paper feeding path.

23. The cooling apparatus according to claim 22, wherein:

the second side wall has a second opening positioned between the developer unit and the fusing unit; and the cooling fan draws external air from the second opening across the fusing unit.

24. A cooling apparatus of an image forming apparatus having a paper feeding path passing a developer unit, a fusing unit, and a paper discharging unit in order, the cooling apparatus comprising:

first and second opposing side walls of the image forming apparatus, having an opening positioned between the developer unit and the fusing unit on one of the first and second side walls; and a cooling fan, positioned on one of the first and second side walls, on the paper feeding path, between the fusing unit and the paper discharging unit, and drawing external air from the opening across the fusing unit in a direction of the paper feeding path.

* * * * *